United States Patent [19]

McCardell

[11] 4,033,663

[45] July 5, 1977

[54] CONNECTOR BLOCK AND TERMINAL ASSEMBLY

[75] Inventor: Willard B. McCardell, Royal Oak, Mich.

[73] Assignee: Altair Tool & Engineering Inc., Mount Clemens, Mich.

[22] Filed: June 4, 1976

[21] Appl. No.: 692,634

Related U.S. Application Data

[62] Division of Ser. No. 628,073, Nov. 3, 1975.

[52] U.S. Cl. ..... 339/128; 248/27.3

[51] Int. Cl.[2] ..... H01R 21/00

[58] Field of Search ..... 339/56, 125, 126, 128, 339/198 GA; 248/27 A, 73, 223

[56] References Cited

UNITED STATES PATENTS

| | | | |
|---|---|---|---|
| 3,353,068 | 11/1967 | Turk | 248/223 |
| 3,355,702 | 11/1967 | Mundschenk et al. | 339/126 R |
| 3,430,188 | 2/1969 | Leach | 339/128 |

*Primary Examiner*—Joseph H. McGlynn
*Attorney, Agent, or Firm*—Burton, Parker & Schramm

[57] ABSTRACT

A connector block and terminal assembly adapted for connecting hook-up wires of a cord set to the internal wiring of an appliance, such as clothes washer or dryer, includes an insulator block having terminal receiving cavities for insertion of terminals connected to the internal wiring, the cavities opening outwardly of the block at access apertures where screw threaded fasteners connected to the terminals may be removed to permit connection of the hook-up wires and then the screws reapplied and tightened to effect an electrical connection between the wires and terminals. A nut associated with each terminal is retained in substantial registry with a screw receiving aperture in the terminal, while the screw is removed for connection of the hook-up wires, by tang means on the terminal. Locking tang means on the block cooperate with the terminals to retain them in the block. The connector block is configured for slidable mounting on the appliance and a locking tang prevents unintentional removal.

7 Claims, 11 Drawing Figures

CONNECTOR BLOCK AND TERMINAL ASSEMBLY

This is a division of application Ser. No. 628,073, filed Nov. 3, 1975.

FIELD OF THE INVENTION

This invention relates to improvements in a connector block and terminal assembly particularly, though not exclusively, adapted for connecting the internal wiring of an appliance, such as a clothes washer or dryer, to the hook-up wires of a cord set intended to be plugged into the wall receptacle to provide electrical power to the appliance.

BACKGROUND OF THE INVENTION

It is conventional in the manufacture of domestic appliances and the like to provide a terminal connector block which is mounted on the wall of the appliance and the internal wiring of the appliance intended to be connected to the source of electric power brought to the block and terminals on such wiring are mounted on the block and hook-up wires which comprise a cord set intended to be plugged into the wall receptacle, are thereafter connected to the terminals at the block.

In effecting the connection between the hook-up wires and the terminals it is desirable to provide a positive physical and electrical connection and therefore screw threaded fasteners are normally provided which cooperate with eyelet terminals on the hook-up wires to secure the wires to the terminals on the block. It has been thought desirable to improve the design of the connector block and terminal assembly such that the same would lend itself to more rapid connection of the internal wiring to the block, reduce the cost of the connector block and terminal assembly and simplify and improve upon the manner in which the connector block is mounted on the appliance wall.

SUMMARY OF THE INVENTION

I have disclosed herein a connector block and terminal assembly permitting the terminal to be connected to the internal wiring of the appliance and then the terminal inserted in the connector block to present a hook-up portion of the terminal for ready access to the mechanic at the time the cord set is to be connected to the appliance. The terminal may be provided with a threaded fastener extending through an aperture in the hook-up portion of the terminal and threadedly connected to a nut with the head of the fastener overlying one side of the hook-up portion of the terminal and the nut overlying the opposite side. The connector Block includes a longitudinal cavity configured to permit insertion of the terminal with its associated threaded fastener, nut and connected internal wiring of the appliance, and when the terminal is fully inserted into the Block the hook-up portion thereof and the head of the fastener are exposed through an access opening in the block to permit connection of the hook-up wires of the cord set.

My design of connector block and terminal assembly is such that when the threaded fastener is removed from the terminal to permit connection of the hook-up wire, the nut associated with the terminal is maintained in substantial registry with the hook-up portion so that the threaded fastener may be easily and readily reengaged therewith to effect connection of the hook-up wires to the terminal. To accomplish this I provide tang means on the terminal engaging the nut and preventing its dislodgement from proper registry with the hook-up portion independent of the threaded fastener. In addition I provide a resilient locking tang on the connector block which cooperates with each inserted terminal to prevent its unintended withdrawal from the block.

My design of the terminal block includes means for slidably attaching it to the wall of the appliance and for such purpose the block includes opposite outwardly opening channels adapted to be slidably received over offset wall portions or tabs of the appliance wall. Resilient locking tangs on the block associated with the channels engage the tabs to prevent unintentional removal of the connector block.

BRIEF DESCRIPTION OF PREFERRED EMBODIMENTS

Figure 1:
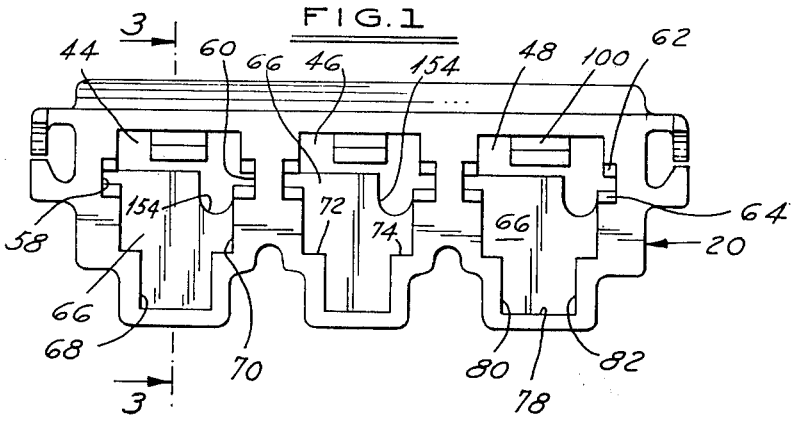
FIG. 1 is a rear view of my improved connector block.
Figure 2:
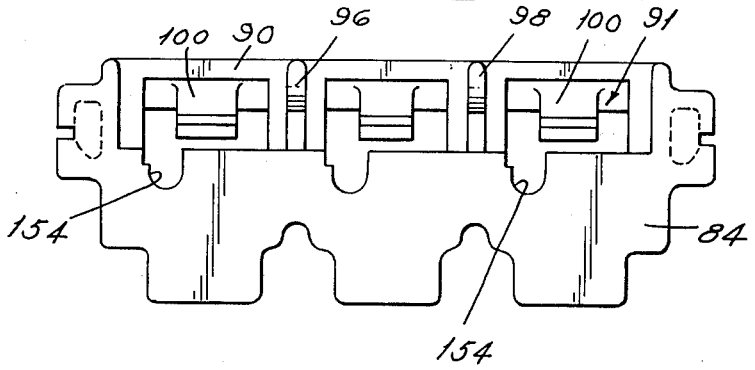
FIG. 2 is a front view of my improved connector block.

As shown in the drawings my improved insulator block (sometimes herein referred to as a connector block) and terminal assembly comprises a molded housing 20 formed of any suitable insulating material possessing the requisite characteristics of strength, limited flexability, moldability and the like, such as the plastic molding material sold by the General Electric Company under the trademark NORYL for its modified polyphenylene oxide. The housing is adapted to receive a plurality of terminals each in its respective cavity formed in the housing and three representative terminals are shown at 22, 24 and 26. A screw fastener 28 and threaded nut 30 are intended to be associated with each terminal and with it comprise a terminal sub-assembly. The design of the block or housing is such that this sub-assembly may be inserted as a unit into the housing after the terminal has been crimped to a conductor wire 32, such as an internal wire of the appliance. Provision is made for mounting the connector block on whatever device, such as a clothes washer is desired. For this purpose a wall or panel portion 34 of the appliance is offset as at 36 to provide confronting tab-like projections 38 and the block is conveniently slidably attached and locked thereto as shown in FIG. 4–8 and as hereinafter described. After mounting the block, the terminals are inserted with their conductor wires, and other electric wires, such as the hook-up wires of a cord-set namely the wires 40 or 42 may be connected to the terminals by loosening or removing the screws 28, applying the hook-up wires, and then replacing and/or tightening the screws as hereinafter described.

The housing 20 has a plurality of longitudinal cavities 44, 46 and 48 which open outwardly of the housing at end 50 to form a terminal receiving entrance 21 and open outwardly spaced from such entrance through an access aperture 91. One cavity is provided for each terminal. For convenience, end 50 of the housing is referred to herein as the rear or back end. Each cavity is large enough to receive the conductor wire 32 and the terminal crimp or gripping portion 52 such that the joint between the terminal and conductor wire is surrounded and protected by the block or housing and only the insulated cover 54 surrounding the wire core is exposed as the conductor exists from the housing. When fully inserted in the cavity the screw 28 is exposed through the access aperture 91 for removal and replacement in connecting the hook-up wires 40 or 42.

Figure 9:
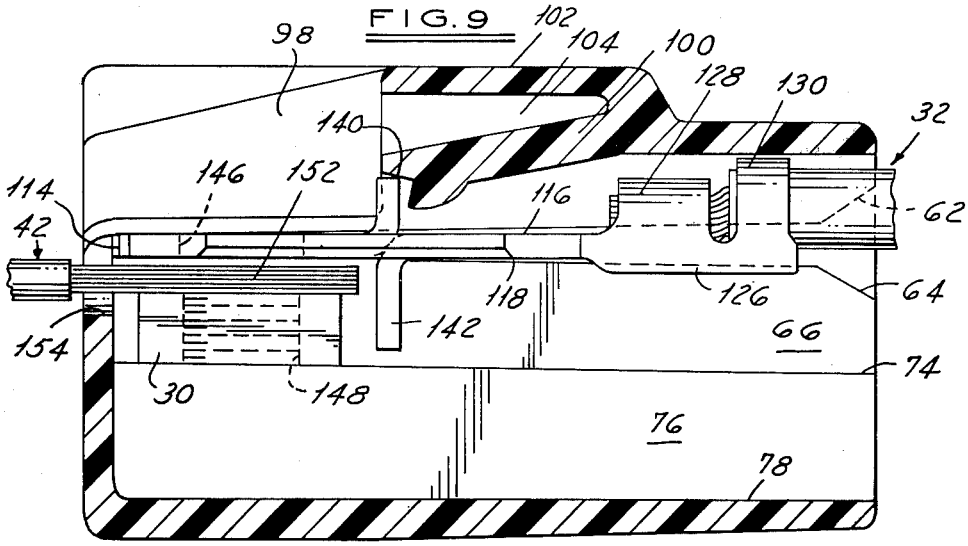
FIG. 9 is a cross sectional view similar to FIG. 3 but with the wire clamping screw removed and a hook-up wire inserted preparatory to clamping.

Each cavity has opposed side walls provided with opposed channels 58 and 60 which extend along the cavity from one end to the other and open thereinto and also open outwardly of the housing at the rear end 50 through chamfered mouths formed by bevelled surfaces 62 and 64, which mouths provide terminal entrances facilitating introduction of the terminals into the cavity. The bottom wall of each cavity is configured to provide an upwardly opening nut receiving channel 66 which opens outwardly at the block at the rear end 50. The nut channel has opposed walls 68 and 70 arranged perpendicular to the opposed channels 58 and 60 spaced apart to allow a free sliding reception of the nut 30 along the channel. The bottom of this channel 66 is defined by bottom wall portions 72 and 74 which are arranged to support the nut 30 for sliding reception along the channel and serve to support the nut adjacent the access opening 91 on the opposite side of the terminal from the access opening, as best shown in FIG. 9. The depth of the nut channel 66 allows slidable introduction of a terminal with its associated nut and screw from the rear end 50 of the housing to the fully inserted position shown in FIG. 3.

The housing 20 is further provided with a screw shank receiving channel 76 which is formed along the bottom of the cavity and opens therein into throughout its length and outwardly of the housing through the rear end 50. This channel has a bottom wall 78 and side wall 80 and 82, the latter being spaced apart sufficiently, and the depth of the channel being such as to allow free passage of the threaded shank 82 of the screw from the rear end 50 of the housing to the position shown in FIG. 3.

The front end of the housing includes a wall 84 which closes the ends of the channels 58, 60, 66 and 76 opposite from the open ends at the rear 50 of the housing. Such wall limits the extent to which the terminals may be inserted in the cavities. The housing also includes a top wall 86 which is stepped upwardly as in 88. This top wall terminates short of the front wall 84 as at 90 providing the access opening 91 heretofor mentioned. The screw head 92 is configured as at 94 to cooperate with a torquing tool such as a screwdriver. Between and separating adjacent access apertures are tapered divider walls or webs 96 and 98 which tend to isolate the adjacent exposed screw heads 92.

Figure 3:
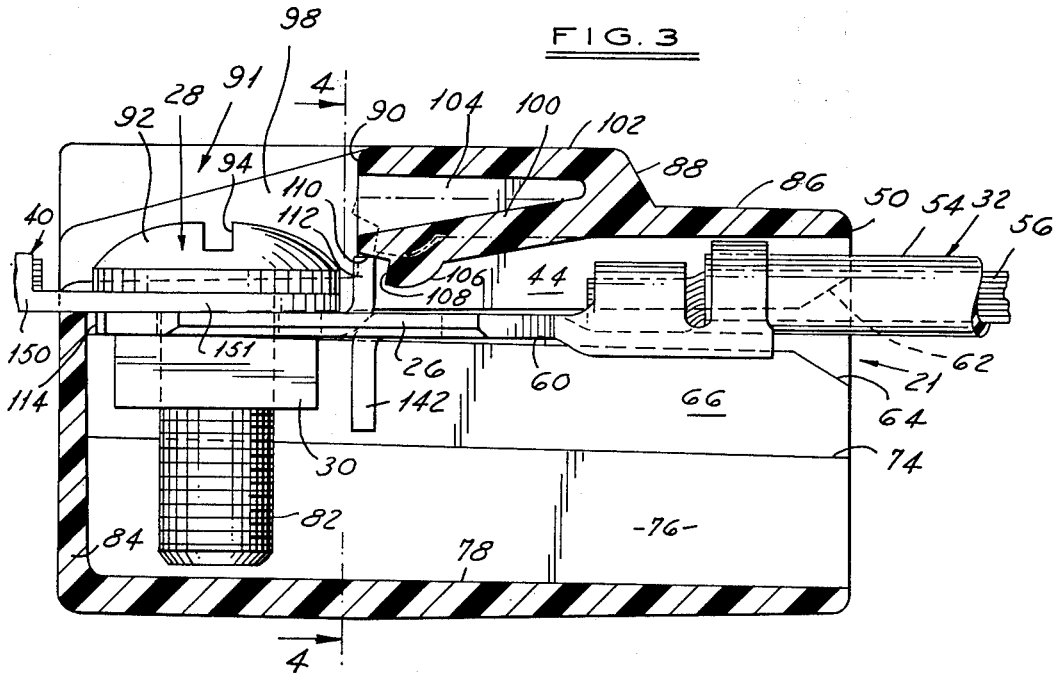
FIG. 3 is a cross sectional view taken on the line 3—3 of FIG. 1 but with a terminal received in the block.
Figure 10:
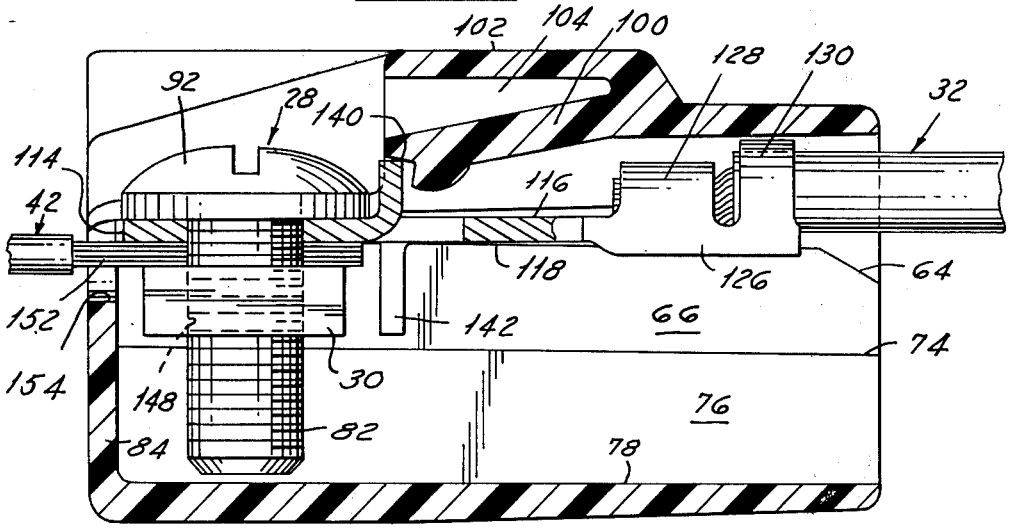
FIG. 10 is a cross sectional view similar to FIG. 9 with the screw in place and the hook-up wire clamped in position.
Figure 11:
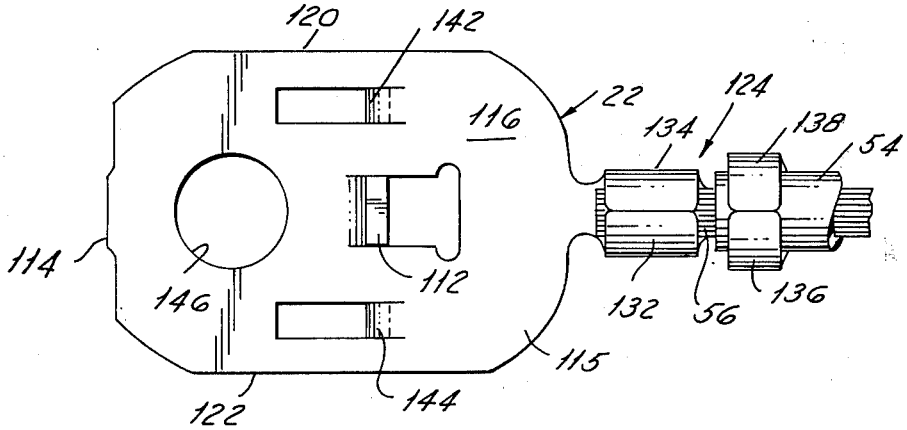
FIG. 11 is a plan view of the top of a terminal embodying the invention.

The top wall 86 of the housing includes integral resilient terminal locking fingers or tangs 100 which extend into the respective cavities, such as the cavity 44 shown in FIG. 3, and which can flex upwardly and thereby be displaced as the terminal is inserted into the cavity. The finger slopes forwardly and downwardly away from the upwardly disposed wall portion 102 of the housing leaving a triangular or wedge shaped space 104 therebetween into which the finger can be flexed to allow entry of the terminal with its associated screw and nut. The finger or tang 100 includes a downwardly and rearwardly extending cam surface 106 which terminates in a forwardly facing notch or catch 108. The notch has a slightly upwardly inclined ledge 110 adapted to rest on an upwardly projecting stop means or tab 112 upstanding from the terminal when the same is fully inserted in the cavity 44. As the terminal is inserted into the cavity through the terminal receiving entrance 21 and is pushed down along the cavity the screw head 92, which is desirably convex, engages the cam surface 106 displacing the finger out of the path of the screw head thereby permitting passage of the terminal. As the finger passes over the surface of the screw head it next encounters the stop or tab 112 and rides over that and when the notch or locking surface 108 clears the tab the finger snaps downwardly behind the tab and an audible click or snapping vibration may be heard or felt as the ledge 110 engages the upper edge of the tab thereby signaling that the terminal is fully and properly seated in the cavity of the housing. When the tab 112 and locking finger are engaged as shown in FIGS. 3, 9 and 10 the front or leading edge 114 of the terminal abuts the front wall 84 of the housing and the terminal is effectively trapped against further movement.

The terminal itself comprises, as shown in FIGS. 3, 4 and 9–11 a conductive member stamped of brass or the like and having a body portion 115 providing the hook-up end of the terminal with opposed generally flat faces 116 and 118 against which the underside of the screw head 92 and the nut 30 may respectively bear. A screw receiving aperture 146 extends through the terminal perpendicular to the faces 116 and 118. The body portion has a front edge 114 which abuts the front wall 184 of the housing when the terminal is fully inserted into the terminal cavity and lateral side edges 120 and 122 which are freely slidably received in relatively close fit in the channels 58 and 60. The body portion of the terminal is further provided at its rear edge with an integral longitudinally projecting wire crimping or gripping portion 124 comprising in elongated extension 126 intergral with the body portion and shaped to provide a wire gripping sleeve 128 and an insulation gripping sleeve 130, each formed by upwardly bent and crimped over portions 132, 134 and 136, 138, respectively, of the elongated extension 126. In some instances the insulator crimping sleeve 130 may be omitted. Such sleeve are tightly wrapped or formed about the wire core 56 and the insulated cover 54 to effect a good connection therewith.

Means are provided on the terminal for retaining it agains unintentional withdrawal from the housing and for retaining the nut in substantial registry with the screw receiving aperture 146 though the screw 28 is removed from the terminal. Such means comprises in the first instance the upstanding stop or tab 112 which is struck up from the body portion 115 of the terminal along the center line thereof. This tab projects upwardly far enough so that the finger 100 is in locked engagement therewith with the ledge 110 resting on the tab when the terminal is fully inserted in the housing. The tab 112 has a sharp rearwardly facing upper edge 140 so that it locks securely in the notch 108 of the finger or tang 100.

The nut retaining means comprises a pair of downwardly extending tabs 142 and 144 struck from the body portion 115 of the terminal in laterally spaced apart relation on opposite sides of the longitudinal center line thereof. These tabs project toward but terminate spaced upwardly from the bottom 72, 74 of the nut receiving channel 66 so that even if the nut is completely released from the screw as shown in FIG. 9, the tab will overlie the edge of the nut and prevent dislodgement from the connector block and maintain the nut in substantial registry with the aperture 164 in the hook-up end of terminal such that upon introducing the screw through the aperture 146 the screw may be threadedly engaged with a nut. The bottom wall portions 72 and 74 of the nut receiving channel provide means for supporting the nut opposite the access aperture 91 when the screw 28 is removed.

The foregoing construction of the block and terminal particularly facilitates securement of the hook-up wires to the terminals in the block. In the case of a hook-up wire having an eyelet end, which is shown in FIG. 3, i.e. an eyelet 40 has a hook-up wire crimping portion 150 which is secured to the hook-up wire (not shown per se) and a flat plate-like closed loop portion 151 which is juxtaposed on the terminal face 116. The screw must be completely removed to permit connection of the eyelet end to the terminal. Following removal of the screw, the eyelet end is juxtaposed on the hook-up end of the terminal in abutment with the face 116 and then the screw shank is introduced through the eyelet and down through the aperture 146 and threadedly engaged with the nut 30 for tightening of the screw head against the eyelet 151. The tabs 142 and 144 retain the nut in position while the screw is removed and during its reengagement with the nut.

Figure 4:
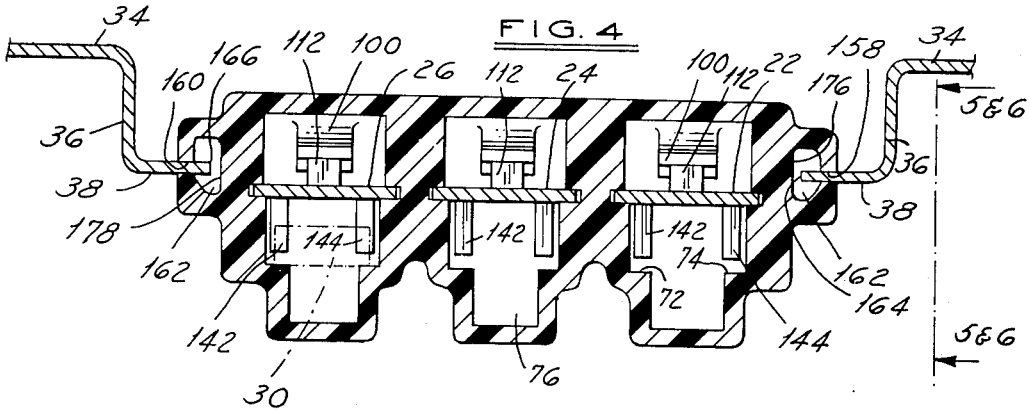
FIG. 4 is a cross sectional view taken on the line 4—4 of FIG. 3 and showing a support for the block.
Figure 6:
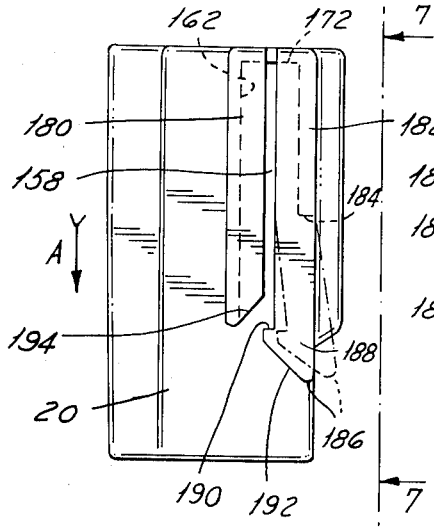
FIG. 6 is a view similar to FIG. 5 but with the support removed for clarity.
Figure 7:
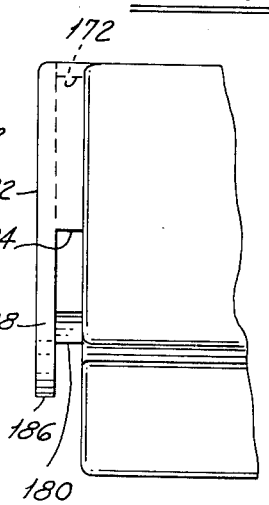
FIG. 7 is a fragmentary view of the block looking in the direction of arrows 7—7 of FIG. 6.

In the case of a hook-up wire having a bare end, i.e. not having an eyelet end, it is desirable to be able to grip the wire to the terminal without subjecting it to the twisting action of the screw head. The construction permitting this is illustrated in FIGS. 9 and 10. The bare wire end is shown at 152. It is inserted through an opening or notch 154 in the front wall 84 of the housing. Such opening or notch is aligned with the underside face 118 of the hook-up end of the terminal. As shown in FIGS. 4 and 9, when the screw 28 is removed the nut drops down and rests on the bottom wall portions 72, 74 of the nut receiving channel thereby providing a space between the nut and the terminal face 118 into which the bare wire end 152 may be inserted. The screw is then introduced into aperture 146 of the terminal and reengaged with the nut and tightened such that the parts are disposed as shown in FIG. 10. To prevent rotation of the nut during torquing of the screw, the nut is preferably of a square shape and sized to be a free sliding fit in the nut channel substantially as shown in FIG. 4, whereby sides of the nut will engage walls 68 and 70 of the nut channel 66 to prevent rotation.

Thus an insulator block and terminal assembly is disclosed which facilitates insertion of the conductor wires and associated terminals and subsequent connection of the hook-up wires either with or without eyelet ends. If desired, the nut 30 and screw 28 need not be assembled to the terminal prior to insertion of the latter in the insulator block. In this case, the nut may be first introduced into the cavity either by insertion from the rear end 50 of the housing and sliding it along the nut channel (as by inserting the terminal behind it such that tabs 142 and 144 engage the nut and push it along the channel into its proper position shown in FIG. 9, or the nut may be dropped into place through the access aperture 91 to rest on the bottom of the nut channel and then the terminal may be inserted into the cavity to trap the nut in position.

Figure 8:
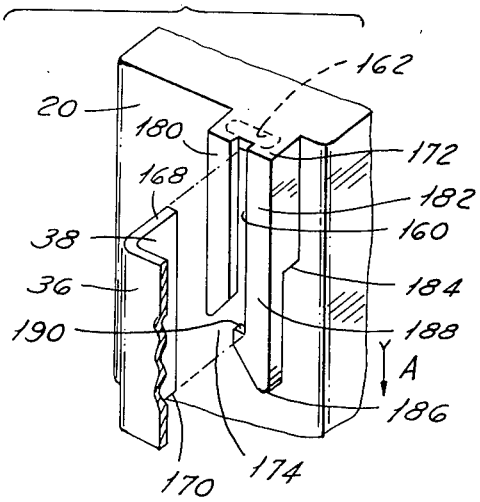
FIG. 8 is a fragmentary exploded perspective view of the block and support mounting arrangement.

I have also disclosed in FIGS. 4–8 means for quickly and easily mounting the insulator block on a support, such as an appliance panel or wall. For this purpose the block or housing is provided with opposite sides 154 and 156 with longitudinally extending oppositely outwardly support receiving channels 158 and 160. The bottom of each channel is enlarged as at 162 to accommodate any burrs on the marginal edges 164 and 166 of the support. In the embodiment disclosed herein, the offset panel portions 38 in effect constitute confronting supports of tab-like configuration, one of which is shown in FIG. 8. Each tab has rearwardly extending extremities 168 and 170. Each channel is closed at one end, as at 172, and open at the opposite end 174 to permit end wise sliding reception in the direction of arrows A over the tabs. The confronting marginal edges 164 and 166 of the supports are spaced apart a distance slightly greater than the distance between the bottom walls 176 and 178 of the enlarged portions of the channels so that any burrs on such edges will not prevent reception of the channels over the tabs.

Figure 5:
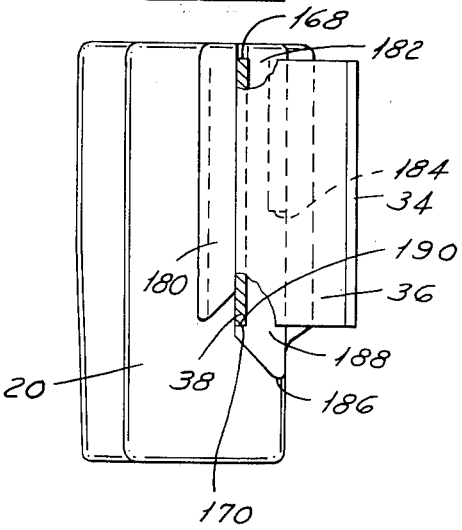
FIG. 5 is a side view of the block taken on the line 5—5 of FIG. 4.

Each channel 158 and 160 has oppposed walls 180 and 182 for closely embracing opposite faces of the supports. Both walls of each channel are integral with the block, but one of them, namely 182, as shown in FIGS. 5–8, is cut away from the block throughout a portion of its length, viz., from edge 184 to its lower edge 186, to provide a resilient locking tang 188 having a notch 190 for snap lock engagement beneath the rearwardly extending lateral edge 170 of the support when it is fully inserted in the channel and edge 168 of the support abuts the closed end 172 of the channel as shown in FIG. 5. The lower or free end 186 of the tang is bevelled at 192 to act as a cam surface to displace the finger out of the path of the tab as it is longitudinally slidably inserted in the channel. The finger or tang flexes or bends as shown in phantom outline in FIG. 6 during insertion of the tab up through the channel. The lower end of the opposite stationary wall of the channel will also be bevelled as at 194 to facilitate introduction of the lateral edge 168 of the tab into the channel.

Thus, to mount the insulator block 20 on the panel, the open ends of its channel 158 and 160 are simply aligned with the tab-like supports 38 and the block is then pushed to slidably engage it therewith and an audible click or sensation assures the mechanic that the block is seated when the locking tangs snap beneath the tabs at each side of the block. In manufacture of the panel, the tabs will be simply punched out of the panel. Alternatively, if desired, the tabs may be spot welded or otherwise affixed to the panel if for any reason an aperture in the panel is not desired.

What is claimed is:

1. A connector block and support assembly comprising, in combination:

a support having a pair of co-planar spaced apart confronting marginal edges defining a connector block receiving space therebetween, a connector block having means thereon for receiving and supporting an electrical terminal, said block having opposite sides shaped to provide opposed longitudinally extending outwardly opening substantially parallel channels for slidable reception in one direction of said confronting marginal edges of the support, and said block having locking tang means for engaging said support adjacent at least one confronting marginal edge and holding the block against reverse slidable removal on said confronting marginal edges.

2. The invention defined by claim 1 characterized in that each of said channels has an enlarged bottom portion opening outwardly through an ensmalled portion with the enlarged bottom portion providing a space for avoiding burrs on said confronting marginal edges and the ensmalled portion adapted to closely embrace opposite faces of the support adjacent said confronting marginal edges.

3. The invention defined by claim 1 characterized in that said support is further provided with a pair of opposed spaced apart lateral edge portions extending rearwardly from each of said confronting marginal edges, said channels are closed at one end with the closed ends adapted to abut one of said lateral edge portions, and said locking tang means adapted to engage the other lateral edge portion whereby the block is trapped against reverse sliding movement.

4. The invention defined by claim 3 characterized in that said locking tang means comprises a resilient latch integral with the block and overhanging the open end of at least one channel and having a face portion for overlying and engaging said other lateral edge.

5. A connector block and panel assembly comprising, in combination:

a panel having spaced apart tab-like projections having confronting marginal edges and lateral rearwardly extending extremities, a connector block of insulating material having opposite sides shaped to exhibit tab receiving channels, each opening outwardly along its length and at one end, for slidable endwise reception over the tabs, and closed at the opposite end to about one lateral extremity of the tab and limit sliding reception of the tab, and resilient tang means on the block at the open end of at least one channel and resistingly displaceable by the tab during insertion in the channel for snap locking over the other lateral extremity of the tab when the same is at the limit of sliding reception in the channel to prevent sliding movement of the block off the tabs.

6. A connector block having means for receiving and supporting terminals thereon;

opposite sides of said block shaped to exhibit opposed longitudinally extending and outwardly opening channels for slidable reception thereinto of the marginal edges of a support member;

tang means on the block for locking the block on the marginal edges of a support member received in the channels; and each of said channels having an enlarged bottom portion opening outwardly through an ensmalled portion of the channel with the bottom portion providing a space for avoiding burns on the marginal edges of a support member received in the channels and the ensmalled portion adapted to closely embrace opposite faces of such support member.

7. A connector block formed of stiffly resilient plastic and having means for receiving and supporting terminals thereon;

opposite sides of said block shaped to exhibit opposed longitudinally extending and outwardly opening channels, said channels opening outwardly at one end for slidable endwise reception of the marginal edge of a support member, each channel having opposed spaced apart walls for embracing the marginal edge of a support member received in the channel;

locking tang means on the block for elastic displacement out of the path of the marginal edge of a support member slidably introduced into the channel and for locking therewith to prevent reverse sliding movement of the block off such support member; and each of said channels having an enlarged bottom portion opening outwardly through an ensmalled portion of the channel with the bottom portion providing a space for avoiding burns on the marginal edges of a support member received in the channels and the ensmalled portion adapted to closely embrace opposite faces of such support member.

* * * * *